US007350968B2

(12) United States Patent
Meerovitsch

(10) Patent No.: US 7,350,968 B2
(45) Date of Patent: Apr. 1, 2008

(54) CASE FOR A WATCH MOVEMENT

(76) Inventor: Alexander Meerovitsch, Unit 706-708, 7F, Tower 2 Metroplaza, 223 Hing Fong Road, Kwai Chung, New Territories (HK)

( * ) Notice: Subject to any disclaimer, the term of this patent is extended or adjusted under 35 U.S.C. 154(b) by 0 days.

(21) Appl. No.: 11/486,289

(22) Filed: Jul. 14, 2006

(65) Prior Publication Data

US 2008/0013408 A1 Jan. 17, 2008

(51) Int. Cl.
*G04B 27/02* (2006.01)

(52) U.S. Cl. ..... 368/190; 368/184; 368/295; 368/69; 368/224

(58) Field of Classification Search ..... 368/190, 368/37, 196, 319, 294, 295, 185, 320, 184, 368/279, 299
See application file for complete search history.

(56) References Cited

U.S. PATENT DOCUMENTS 2,362,245 A * 11/1944 Cohen ..... 368/190
2,547,140 A * 4/1951 Schmitz ..... 368/190
3,910,034 A * 10/1975 Tilse ..... 368/12
4,253,177 A 2/1981 Hafner
5,742,565 A 4/1998 Cuinet et al.
5,745,440 A * 4/1998 Chen ..... 368/27
6,010,241 A * 1/2000 Bulgari ..... 368/190
6,379,037 B1 * 4/2002 Saleh et al. ..... 368/185
6,548,588 B1 * 4/2003 Coogan et al. ..... 524/457
6,579,004 B1 * 6/2003 Kim ..... 368/295
6,980,488 B2 12/2005 Schneider
2005/0162985 A1 * 7/2005 Speichinger ..... 368/319

* cited by examiner

*Primary Examiner*—P. Austin Bradley
*Assistant Examiner*—Sean Kayes
(74) *Attorney, Agent, or Firm*—Leydig, Voit & Mayer, Ltd.

(57) ABSTRACT

A watch case for an analog watch movement has a housing and a setting ring in a rotatably moveable and axially slideable relationship. The setting ring is coupled with a setting stem of the analog watch for rotation of the setting stem by rotation of the setting ring and for axial movement of the setting stem by orthogonal axial movement of the setting ring.

13 Claims, 3 Drawing Sheets

CASE FOR A WATCH MOVEMENT

BACKGROUND TO THE INVENTION

1. Field of the Invention

The current invention relates to timepieces and in particularly to wristwatches. More specifically, the current invention relates to watch case for an analog watch movement having a rotational setting stem extending from the movement and moveable axially to positions for performing setting functions of the movement by rotation of the setting stem.

2. Background Information

Axially moveable crown setting devices for analog watch movements are well known. The setting device comprises a setting stem extending from the watch movement and through the watch housing. A crown is located on the end of the setting stem outside the watch housing. For setting various features of the watch; for example time, date, calendar and/or alarm; the crown is manually pulled-out to one of multiple detent positions causing setting gears of the setting stem to engage with the movement. The crown is turned to adjust the movement mechanism for setting the desired feature.

Crown setting devices of this type can be difficult to use for persons with limited hand or finger movement, large stumpy fingers or who are wearing gloves or are simply not nimble-fingered generally. The crown is usually small in diameter and difficult to grasp to pull-out and to rotate. Additionally, it can be an irksome task if significant adjustment of the movement is required, for example the time must be advanced or backed by several hours.

SUMMARY OF THE INVENTION

Accordingly, is an object of the present invention to provide a watch case for an analog watch movement that provides an improved setting means for the watch movement or which at least provides the public with a useful alternative.

In view of the forgoing, there is disclosed herein a watch case for an analog watch movement having a rotational setting stem extending from the movement and movable in a first axial direction to positions for performing setting functions of the movement. The watch case comprises a housing and a setting ring rotatably positioned on the housing. The setting ring is rotatable on the housing and movable on the housing in a second axial direction. The setting ring is coupled with the setting stem for rotation of the setting stem by means of rotation of the setting ring and for axial movement of the setting stem by means of axial movement of the setting ring. Typically, although not exclusively, the second axial direction is orthogonal to the first axial direction.

Preferably, the setting ring is coupled with the setting stem by a toothed crown located on the end of the setting stem and a pinion gear that meshes with the toothed crown and with teeth on a circumferential inner surface of the setting ring. A spring is located about the setting stem between the housing and the crown for biasing the setting stem in the first axial direction.

Preferably, the watch case further includes multiple detents for axially positioning the setting ring on the housing. The detents comprise multiple circumferential groves about the watch case and a detent catch for engaging with one of the multiple circumferential groves.

Preferably, the setting ring surrounds a middle portion of the housing, and encloses the toothed crown.

Preferably, the housing comprises a base having a lower flange at its periphery, a housing wall inwardly of the lower flange that defines a movement space and a top plate located at an upper edge of the housing wall and having an upper flange at its periphery. And, the setting ring comprises a cylindrical ring having a center flange, the center flange having upper and lower limbs cooperating with the upper and lower flanges respectively.

There is also disclosed herein a wristwatch having the watch case referred to above.

Further disclosure of the invention will become apparent from the following description.

BRIEF DESCRIPTION OF THE DRAWINGS

An exemplary form of the present invention will now be described by way of example only and with reference to the accompanying drawings, in which.

DESCRIPTION OF THE EXEMPLARY EMBODIMENTS

In the attached drawings features of a watch or watch casing well known in the art and not critical to the invention are not depicted or described for clarity. For example the back, dial, hands and strap are not shown nor described. This is not intended to limit the scope of use or functionality of the invention and those skilled in the art will appreciate the requirements for these regular features.

In the attached drawings there is depicted a watch housing for an analog watch movement which provides an alternative setting means for the movement. An analog watch movement for use with the watch case of the invention is one that has a rotational setting stem extending from the movement and which stem is axially moveable to multiple detent positions for performing setting functions of the movement by rotation of the stem. The watch case comprising a housing and a setting ring rotatably positioned on the housing. The setting ring is rotatable on the housing and movable on the housing in an axial direction orthogonal to the axial direction of the setting stem. The setting ring is coupled with the setting stem for rotation of the setting stem by means of rotation of the setting ring and for axial movement of the setting stem by means of orthogonal axial movement of the setting ring.

Figure 4:
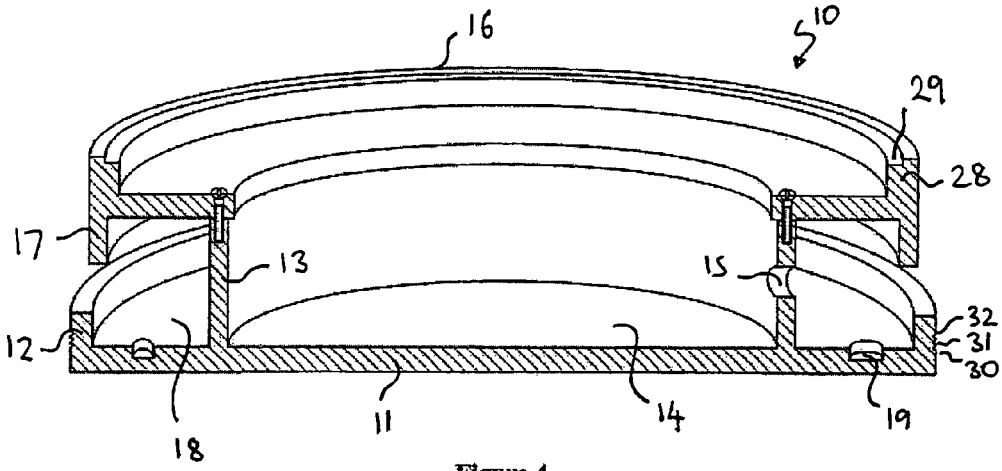
FIG. 4 is a schematic section diagram of a second part of the watch housing of FIG. 1.

The housing 10, shown separately in FIG. 4, comprises a base 11 having an upwardly extending lower flange 12 about its outer periphery. Inwardly of the lower flange 12 is an upwardly extending housing wall 13 defining a movement space 14 in a center portion of the housing for locating a watch movement. An aperture 15 is provided in the housing wall 13 so that the setting stem 2 of a watch movement 1 can protrude outside the movement space 14. Removably fixed to the top of the housing wall 13 is a top plate 16 having a downwardly extending upper flange 17 about its outer periphery. The housing wall 13 and upper and lower flanges 17, 12 define an annular shaped gear space 18 within the circumference of the housing 10. The upper surface of the top plate 16 supports a dial, which is not shown. The top plate 16 also has an upwardly extending dial wall 28 about its outer periphery. At the top of the dial wall 28 is a groove 29 for receiving the watch crystal 22. The top plate 16 in the depicted embodiment has a large circular opening at its center however other embodiments may have a smaller opening substantially enclosing the movement space 14. Of course, the top plate 16 will have at least a small aperture at its center through which a spindle extends for attachment of hands to the movement.

Figure 3:
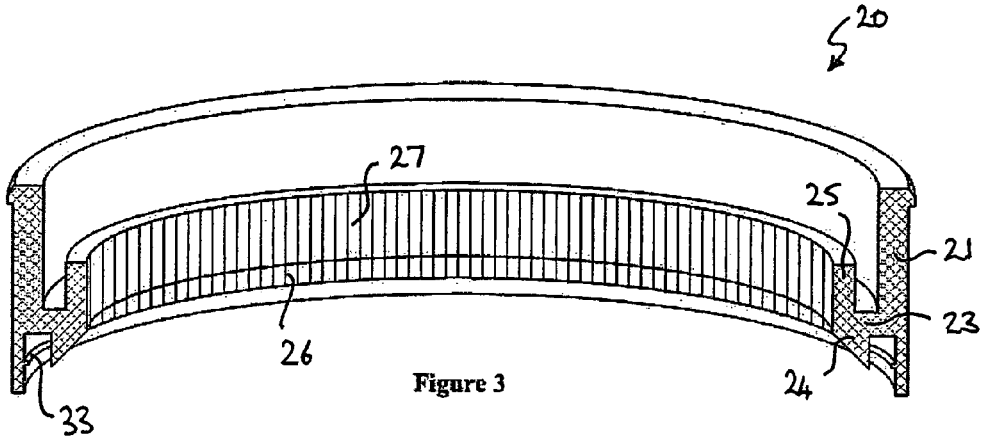
FIG. 3 is a schematic section diagram of a first part of the watch housing of FIG. 1.

Surrounding the housing 10 and rotatably and axially slideable with the housing 10 is a setting ring 20. The setting ring 20 is separately depicted in FIG. 3. The setting ring 20 comprises a cylindrical outer wall 21. Extending upwardly about the inner circumference of the outer wall 21 is a T-shaped center flange 23 having upper and lower limbs 24, 25. The inner circumference of the center flange 23 has a toothed surface 27 and lower limb 25 has a downwardly orientated circumferential toothed surface 26. The plane of the toothed surface 26 is 45-degree to toothed surface 27.

The housing 10 and setting ring 20 are assembled together in a rotatably moveable and axially slideable relationship by removal of the top plate 16. In situ, the upper and lower limbs 24, 25 of T-shaped center flange 23 cooperate with the upper and lower flanges 17, 12 of the housing such that the toothed surface 26 is located within the gear space 18. The setting ring closes the gear space 18.

Figure 1:
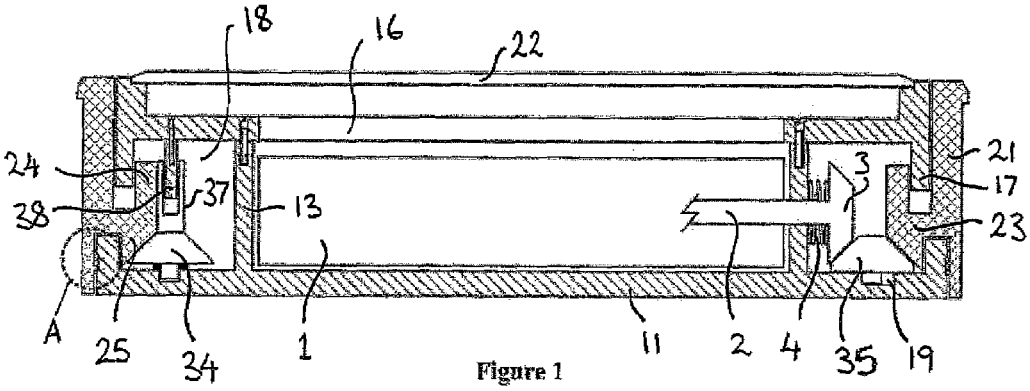
FIG. 1 is a first schematic section diagram of a watch housing according to the invention.
Figure 2:
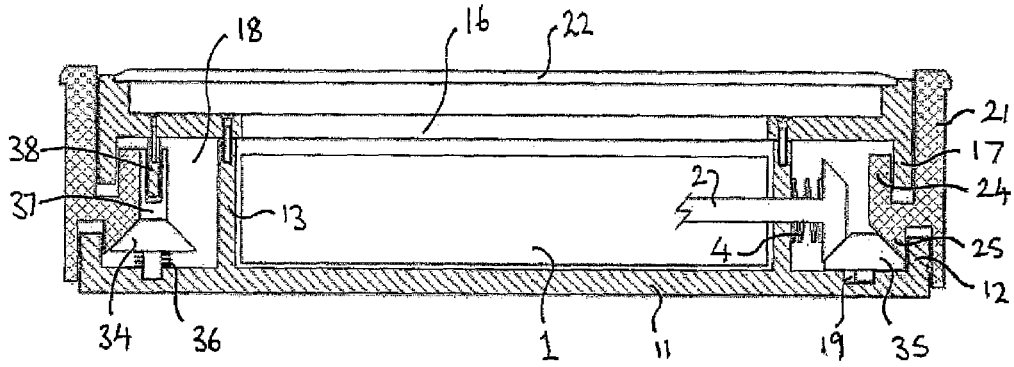
FIG. 2 is a second schematic section diagram of the housing of FIG. 1.
Figure 5:
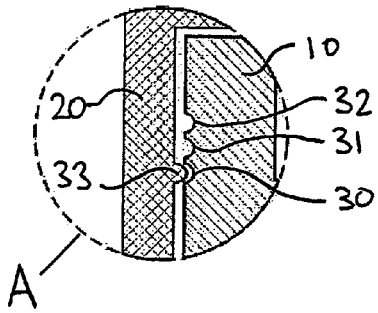
FIG. 5 is an enlarged schematic diagram of the detent area 'A' of FIG. 1.
Figure 6:
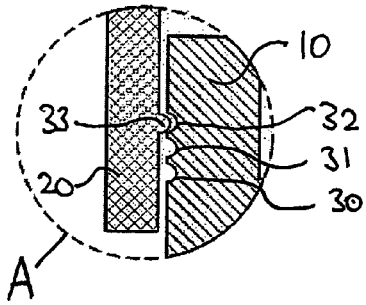
FIG. 6 is a second enlarged schematic diagram of area 'A' of FIG. 1 depicting axial movement of the parts.
Figure 7:
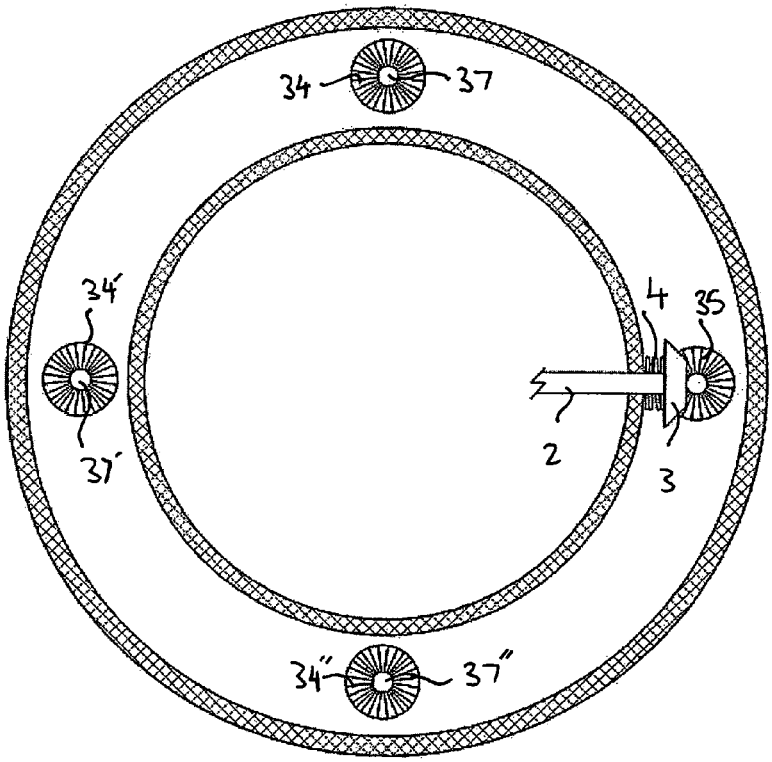
FIG. 7 is a schematic diagram of the part of FIG. 4 showing the position of multiple pinion gears.

Multiple detents, depicted in FIGS. 5 and 6, are provided for axially positioning the setting ring 20 on the housing 10. The detents comprise multiple circumferential grooves 30, 31, 32 axially spaced about the outside circumference of the lower flange 12 of housing 10 and a detent bead 33 located about the inner circumference of setting ring 20 for engaging with one of the multiple circumferential groves 30, 31, 32. In the depicted embodiment there are three detent grooves 30, 31, 32 providing two setting positions. FIGS. 1 and 5 depict the normal non-setting position with detent bead 33 engaging groove 30. FIGS. 2 and 6 depict a second setting position with detent bead 33 engaging groove 32. A first setting position with detent bead 33 engaging groove 31 is not shown.

Mounted on the bottom plate 11 within gear space 18 are four 45-degree pinion gears 34, 35. The pinion gears 34, 35 are positioned at equidistant spacing about the annular gear space 18 and are arranged to mesh with the toothed surface 26 of the setting ring 20. Three of the pinion gears 34 are upwardly biased by pinion springs 36 for maintaining meshing force between the pinion gears 34 and the 45-degree toothed surface 26 in any of the detent positions. Atop of each of the three pinion gears 34 is an axially cut cylindrical gear 37. The cylindrical gears 37 are attached to respective ones of the pinion gears 34 and slideably and rotatably located over spindles 38 attached to the underside of top plate 16. The cylindrical gears 37 mesh with the inner toothed surface 27 of centre flange 23 and provide additional rotational and axially slideable engagement to steady the setting ring.

The fourth gear, a setting pinion gear, 35 is located adjacent the setting stem aperture 15 in housing wall 13. The spindle of the setting pinion gear 35 is rotatably located in a radial slot 19 in base 11.

In a watch using the watch case of the current invention an analog watch movement 1 is located within the movement space 14 with its setting stem 2 extending through aperture 15 of housing wall 13. A toothed crown 3 is located on external end of the setting stem 2 and meshes with the setting pinion gear 35. A setting spring 4 is located about the setting stem 2 between the housing wall 13 and the crown 3 for biasing the setting stem 2 in an axial direction. This biasing force of setting spring 4 maintains a meshing force between the crown 3, setting pinion 35 and toothed surface 26 of the setting ring such that rotation of the setting ring causes rotation of the setting stem 2.

For setting functions of the movement the setting ring 20 is moved axially relative the housing 10 to one of the two detent setting positions. As the setting ring 20 is moved axially upwards from the normal position, depicted in FIGS. 1 and 5, to, say, the second setting position, depicted in FIGS. 2 and 6, the toothed surface is moved in a direct way from the analog movement. The axial biasing force of the setting spring 4 pushes the setting stem 2 and crown 3 axially outwards moving the setting pinion 35 within slot 19 and maintaining meshing force between the crown 3, setting pinion 35 and toothed surface 26. In doing so, the setting stem 4 and crown 3 are moved out to one of the watch movement's setting positions causing setting gears of the setting stem 2 to engage with the watch movement. Rotation of the setting ring 20 about the housing 10 rotates of the setting stem 2 to adjust the watch movement for setting the desired feature.

Thus, the setting ring 20 is coupled with the setting stem 2 for rotation of the setting stem 2 by means of rotation of the setting ring 20 and for axial movement of the setting stem 2 by means of an orthogonal axial movement of the setting ring 20.

The setting ring device of the watch case is easier to use for persons with limited hand or finger movement, large stumpy fingers or who are wearing gloves or are simply not nimble-fingered. The setting ring is easier to move to detent setting positions and to rotate. Additionally, a gearing ratio is or can be achieved through the setting ring, setting pinion and crown so that large setting adjustments can be made more quickly with less effort.

The watch case of the invention also hides the crown within the gear space enclosed by the setting ring providing a cleaner more elegant look to the watch case.

It should be appreciated that modifications and alternations obvious to those skilled in the art are not to be considered as beyond the scope of the present invention. For example, in the described embodiment there are only two detent setting positions, in another embodiment there are three setting positions, but other embodiments may have just one setting positions or more than three setting positions depending on the movement setting requirements.

What is claimed is:

1. A watch case for an analog watch movement having a rotational setting stem extending from the movement and movable along an axial direction of the setting stem to positions for performing setting functions of the movement by rotation of the setting stem, the stem being connected with a toothed crown, the watch case comprising:

a housing, and a setting ring rotatably positioned on the housing and movable along an axial direction of the housing, the setting ring being coupled with the setting stem for rotation of the setting stem by rotation of the setting ring and for axial movement of the setting stem along the axial direction of the setting stem by axial movement of the setting ring along the axial direction of the housing.

2. The watch case of claim 1 wherein the axial direction of the housing is orthogonal to the axial direction of the setting stem.

3. The watch case of claim 1 further including a pinion gear for engagement with the toothed crown, wherein the setting ring has teeth on a circumferential inner surface for meshing with the pinion gear.

4. The watch case of claim 1 further including multiple detents for axially positioning the setting ring at multiple respective positions with respect to and along the axial direction of the housing.

5. The watch case of claim 4 wherein the detents comprise multiple circumferential grooves in the watch case and a detent catch on the setting ring for selectively engaging the multiple circumferential grooves.

6. The watch case of claim 1 wherein the setting ring surrounds a middle portion of the housing.

7. The watch case of claim 6 wherein the setting ring and housing enclose the toothed crown.

8. The watch case of claim 1 including a spring located about the setting stem, between the housing and the toothed crown, biasing the setting stem along the axial direction of the setting stem.

9. The watch case of claim 1 wherein the housing comprises a base having a peripheral lower flange, a housing wall inwardly of the lower flange that defines a movement space for accommodating the watch movement, and a top plate located at an edge of the housing wall and having a peripheral upper flange.

10. The watch case of claim 9 wherein the setting ring comprises a cylindrical ring having a center flange, the center flange having upper and lower limbs cooperating with the upper and lower flanges, respectively.

11. A case for a watch movement having a rotational setting stem movable along an axial direction of the stem to setting positions of the watch movement, the case comprising:

a housing comprising a base having a peripheral lower flange, a housing wall inwardly of the lower flange defining a movement space for accommodating the watch movement, and a top plate having a peripheral upper flange, and a setting ring rotatably positioned with respect to the housing and movable relative to the housing along an axial direction of the housing, the setting ring comprising a cylindrical ring and a center flange having upper and lower limbs cooperating with the upper and lower flanges, respectively, wherein the setting ring is coupled with the setting stem for rotation of the setting stem by rotation of the setting ring and for movement of the setting stem along the axial direction of the setting stem by movement of the setting ring along the axial direction of the housing.

12. A watch comprising:

a housing, a watch movement located in the housing and having a rotational setting stem movable along an axial direction of the setting stem to positions for performing setting functions of the watch movement by rotation of the setting stem, and a setting ring moveable rotationally about and slideably along an axial direction of the housing, the setting ring being coupled with the setting stem for (i) rotation of the setting stem about the axial direction of the setting stem, by rotation of the setting ring about the axial direction of the housing, and (ii) for axial movement of the setting stem along the axial direction of the setting stem, by movement of the setting ring along the axial direction of the housing, orthogonal to the axis of the setting stem.

13. A watch case for an analog watch movement having a rotational setting stem extending from the watch movement and movable along and rotationally about an axis of the setting stem for setting functions of the watch movement, the watch case comprising:

a housing for the analog watch movement; and a peripheral setting ring peripherally surrounding the housing, having an axis, and couplable to the setting stem, the setting ring, in response to movement along the axis of the setting ring, moving the setting stem axially along the axis of the setting stem, and in response to rotation about the axis of the setting ring, moving the setting stem rotationally about the axis of the setting stem.

* * * * *